US010689958B2

(12) United States Patent
Moffett et al.

(10) Patent No.: US 10,689,958 B2
(45) Date of Patent: Jun. 23, 2020

(54) APPARATUS AND METHODS FOR OPERATING GAS LIFT WELLS

(71) Applicant: Weatherford Technology Holdings, LLC, Houston, TX (US)

(72) Inventors: Ross Moffett, Kingwood, TX (US); Ashish Rakhit, Katy, TX (US); Stephen Long, The Woodlands, TX (US); Michael S. Juenke, Spring, TX (US); Stephen E. Cannon, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 619 days.

(21) Appl. No.: 15/388,276

(22) Filed: Dec. 22, 2016

(65) Prior Publication Data

US 2018/0179869 A1 Jun. 28, 2018

(51) Int. Cl.

| | |
|---|---|
| ***E21B 43/12*** | (2006.01) |
| ***E21B 41/00*** | (2006.01) |
| ***E21B 47/04*** | (2012.01) |
| ***E21B 47/06*** | (2012.01) |

(52) U.S. Cl.

CPC ..... *E21B 43/122* (2013.01); *E21B 41/0092* (2013.01); *E21B 47/04* (2013.01); *E21B 47/06* (2013.01)

(58) Field of Classification Search

CPC ..... E21B 43/121; E21B 43/122; E21B 43/123
See application file for complete search history.

(56) References Cited

U.S. PATENT DOCUMENTS

| | | | | |
|---|---|---|---|---|
| 4,267,885 | A * | 5/1981 | Sanderford | E21B 43/122 166/250.01 |
| 4,410,038 | A | 10/1983 | Drapp | |
| 4,633,954 | A | 1/1987 | Dixon et al. | |
| 4,685,522 | A * | 8/1987 | Dixon | E21B 43/00 137/624.2 |
| 5,033,550 | A * | 7/1991 | Johnson | E21B 23/03 166/105 |
| 5,735,346 | A * | 4/1998 | Brewer | E21B 43/122 166/250.03 |
| 5,871,048 | A * | 2/1999 | Tokar | C09K 8/62 137/155 |

(Continued)

OTHER PUBLICATIONS

European Search Report for EP 17 20 8242 dated Apr. 17, 2018.

*Primary Examiner* — Michael J Dalbo

(74) *Attorney, Agent, or Firm* — Patterson + Sheridan, LLP

(57) ABSTRACT

An exemplary method of the present disclosure includes causing, by a processing system proximate to the wellbore, injection of the lift gas into the wellbore at a first gas injection rate; obtaining, by the processing system, a first indication of a parameter associated with the wellbore, an arrival of a first fluid at a wellhead associated with the wellbore, or a composition of the first fluid; determining, by the processing system and based on the first indication, at least one of: a second gas injection rate of the intermittent gas lift system, a first period to inject the lift gas with the intermittent gas lift system, or a second period, subsequent to the first period, with no injection of the lift gas by the intermittent gas lift system; and operating, by the processing system, the intermittent gas lift system according to the determination.

24 Claims, 9 Drawing Sheets

(56) References Cited

U.S. PATENT DOCUMENTS

| | | | | |
|---|---|---|---|---|
| RE42,245 | E | 3/2011 | Thomas et al. | |
| 8,078,444 | B2 | 12/2011 | Rashid et al. | |
| 8,670,966 | B2 | 3/2014 | Rashid et al. | |
| 2002/0016679 | A1 | 2/2002 | Thomas et al. | |
| 2003/0047308 | A1* | 3/2003 | Hirsch | E21B 17/003 166/250.15 |
| 2004/0216886 | A1* | 11/2004 | Rogers, Jr. | E21B 43/121 166/372 |
| 2005/0038603 | A1 | 2/2005 | Thomas et al. | |
| 2006/0102346 | A1 | 5/2006 | Casey | |
| 2007/0175633 | A1 | 8/2007 | Kosmala et al. | |
| 2008/0140369 | A1 | 6/2008 | Rashid et al. | |
| 2009/0084545 | A1 | 4/2009 | Banerjee et al. | |
| 2011/0119037 | A1 | 5/2011 | Rashid et al. | |
| 2014/0094974 | A1 | 4/2014 | Rashid | |
| 2014/0156238 | A1* | 6/2014 | Rashid | E21B 43/00 703/2 |
| 2016/0237814 | A1 | 8/2016 | Fripp et al. | |
| 2017/0356278 | A1* | 12/2017 | Nandola | E21B 43/128 |
| 2018/0010944 | A1* | 1/2018 | Xie | G01F 1/74 |

* cited by examiner

APPARATUS AND METHODS FOR OPERATING GAS LIFT WELLS

BACKGROUND

Field of the Disclosure

Aspects of the present disclosure generally relate to hydrocarbon production using gas lift and, more particularly, to operating a gas lift unit in a wellbore based on measurements of one or more sensed parameters associated with the gas lift unit and/or the wellbore.

Description of the Related Art

Several artificial lift techniques are currently available to initiate and/or increase hydrocarbon production from drilled wells. These artificial lift techniques include rod pumping, plunger lift, gas lift, hydraulic lift, progressing cavity pumping, and electric submersible pumping, for example.

Typical gas lift techniques involve pumping a lift gas down the casing-tubing annulus of a well. The lift gas travels down the casing-tubing annulus to one or more subsurface gas injection valves that enable the lift gas to enter the tubing string. The lift gas commingles with the reservoir fluids in the tubing string, lifting the reservoir fluids up the tubing string to the surface. Oil in the fluids may then be recovered.

A gas lift system may be operated on a continuous basis, in which the lift gas is continuously injected into the well, or on an intermittent basis, in which the lift gas is injected for a first period (e.g., an "on time") and then the injection is stopped for a second period (e.g., an "off time"). The periods may be the same or different lengths. The intermittently operated gas lift system may repeat the periods, or the lengths of the periods may be adjusted one or more times per cycle.

The injection rate of the lift gas, length of time for gas injection (e.g., the on time), and length of time between stopping gas injection and restarting the gas injection (e.g., the off time) all affect the quantity of oil recovered from a well. Gas lift systems entail an investment of capital to implement and cost money to operate. Production companies prefer to maximize the return on capital investments and operating costs. Accordingly, there is a need for apparatus and methods of determining lift gas injection rates, on times, and/or off times of intermittently operated gas lift systems to operate wells using such systems more economically.

SUMMARY

Aspects of the present disclosure generally relate to measuring one or more parameters associated with a wellbore and/or a gas lift unit and taking a course of action or otherwise operating the gas lift unit based on the measured parameters.

In one aspect, a method of operating an intermittent gas lift system operable to inject lift gas into a wellbore for hydrocarbon production is provided. The method generally includes causing, by a processing system proximate to the wellbore, injection of the lift gas into the wellbore at a first gas injection rate; obtaining, by the processing system, a first indication of a parameter associated with the wellbore, an arrival of a first fluid at a wellhead associated with the wellbore, or a composition of the first fluid; determining, by the processing system and based on the first indication, at least one of: a second gas injection rate of the intermittent gas lift system, a first period to inject the lift gas with the intermittent gas lift system, or a second period, subsequent to the first period, with no injection of the lift gas by the intermittent gas lift system; and operating, by the processing system, the intermittent gas lift system according to the determination.

In another aspect, a method of operating a gas lift system operable to inject lift gas into a wellbore for hydrocarbon production is provided. The method generally includes obtaining a first indication of a first liquid production rate of the wellbore; obtaining one or more second indications of second liquid production rates of one or more other wellbores; determining a first slope, of a first curve relating a plurality of liquid production rates of the wellbore to a plurality of gas injection rates of the wellbore, at a point on the first curve corresponding to the first liquid production rate; determining one or more second slopes, of one or more second curves, each second curve relating a plurality of liquid production rates of one of the one or more other wellbores to a plurality of gas injection rates of the one of the other wellbores, each second slope being determined at a point on the second curve corresponding to one of the second liquid production rates of the one of the other wellbores; calculating a weighted average of the first slope and the second slopes, with the weighted average weighted based on the first and second liquid production rates of the wellbore and the other wellbores, respectively; determining a first gas injection rate such that a third slope, of the first curve, at a point on the first curve corresponding to the first gas injection rate, is equal to the calculated weighted average; and causing injection of the lift gas into the wellbore at the first gas injection rate.

In another aspect, a method of operating a continuous gas lift system operable to inject a lift gas into a wellbore for hydrocarbon production is provided. The method generally includes causing, by a processing system proximate to the wellbore, injection of the lift gas into the wellbore at a first gas injection rate; obtaining, by the processing system, a first indication of a pressure at a location of the wellbore while the injection of the lift gas at the first gas injection rate is ongoing; determining, by the processing system and based on the first indication and the first gas injection rate, a second gas injection rate for the continuous gas lift system; and causing, by the processing system, the continuous gas lift system to inject lift gas into the wellbore at the second gas injection rate.

In one aspect, a non-transitory computer readable medium containing a program is provided. The program, when executed by a processing system, causes the processing system to perform operations generally including causing injection of a lift gas into the wellbore at a first gas injection rate by an intermittent gas lift system; obtaining a first indication of a parameter associated with the wellbore, an arrival of a first fluid at a wellhead associated with the wellbore, or a composition of the first fluid; determining, based on the first indication, at least one of: a second gas injection rate of the intermittent gas lift system, a first period to inject the lift gas with the intermittent gas lift system, or a second period, subsequent to the first period, with no injection of the lift gas by the intermittent gas lift system; and causing the intermittent gas lift system to operate according to the determination.

In another aspect, a non-transitory computer readable medium containing a program is provided. The program, when executed by a processing system, causes the processing system to perform operations generally including obtaining a first indication of a first liquid production rate of the wellbore; obtaining one or more second indications of second liquid production rates of one or more other wellbores; determining a first slope, of a first curve relating a plurality of liquid production rates of the wellbore to a plurality of gas injection rates of the wellbore, at a point on the first curve corresponding to the first liquid production rate; determining one or more second slopes, of one or more second curves, each second curve relating a plurality of liquid production rates of one of the one or more other wellbores to a plurality of gas injection rates of the one of the other wellbores, each second slope being determined at a point on the second curve corresponding to one of the second liquid production rates of the one of the other wellbores; calculating a weighted average of the first slope and the second slopes, with the weighted average weighted based on the first and second liquid production rates of the wellbore and the other wellbores, respectively; determining a first gas injection rate such that a third slope, of the first curve, at a point on the first curve corresponding to the first gas injection rate, is equal to the calculated weighted average; and causing injection of the lift gas into the wellbore at the first gas injection rate.

In another aspect, a non-transitory computer readable medium containing a program is provided. The program, when executed by a processing system, causes the processing system to perform operations generally including causing injection of lift gas into the wellbore at a first gas injection rate by a continuous gas lift system; obtaining a first indication of a pressure at a location of the wellbore while the injection of the lift gas at the first gas injection rate is ongoing; determining, based on the first indication and the first gas injection rate, a second gas injection rate for the continuous gas lift system; and causing the continuous gas lift system to inject the lift gas into the wellbore at the second gas injection rate.

In another aspect, a controller is provided. The controller includes a processing system configured to perform operations generally including causing injection of a lift gas into the wellbore by an intermittent gas lift system at a first gas injection rate; obtaining a first indication of a parameter associated with the wellbore, an arrival of a first fluid at a wellhead associated with the wellbore, or a composition of the first fluid; determining, based on the first indication, at least one of: a second gas injection rate of the intermittent gas lift system, a first period to inject the lift gas with the intermittent gas lift system, or a second period, subsequent to the first period, with no injection of the lift gas by the intermittent gas lift system; and causing the intermittent gas lift system to operate according to the determination.

In another aspect, a controller is provided. The controller includes a processing system configured to perform operations generally including obtaining a first indication of a first liquid production rate of the wellbore; obtaining one or more second indications of second liquid production rates of one or more other wellbores; determining a first slope, of a first curve relating a plurality of liquid production rates of the wellbore to a plurality of gas injection rates of the wellbore, at a point on the first curve corresponding to the first liquid production rate; determining one or more second slopes, of one or more second curves, each second curve relating a plurality of liquid production rates of one of the one or more other wellbores to a plurality of gas injection rates of the one of the other wellbores, each second slope being determined at a point on the second curve corresponding to one of the second liquid production rates of the one of the other wellbores; calculating a weighted average of the first slope and the second slopes, with the weighted average weighted based on the first and second liquid production rates of the wellbore and the other wellbores, respectively; determining a first gas injection rate such that a third slope, of the first curve, at a point on the first curve corresponding to the first gas injection rate, is equal to the calculated weighted average; and causing injection of the lift gas into the wellbore at the first gas injection rate.

In another aspect, a controller is provided. The controller includes a processing system configured to perform operations generally including causing injection of lift gas into the wellbore at a first gas injection rate by a continuous gas lift system; obtaining a first indication of a pressure at a location of the wellbore while the injection of the lift gas at the first gas injection rate is ongoing; determining, based on the first indication and the first gas injection rate, a second gas injection rate for the continuous gas lift system; and causing, by the processing system, the continuous gas lift system to inject the lift gas into the wellbore at the second gas injection rate.

In another aspect, a system for injecting lift gas into a wellbore for hydrocarbon production is provided. The system generally includes a pump operable to intermittently inject the lift gas into the wellbore; and a processing system coupled to the pump and configured to cause the pump to inject the lift gas into the wellbore at a first gas injection rate; to obtain a first indication of a parameter associated with the wellbore, an arrival of a first fluid at a wellhead associated with the wellbore, or a composition of the first fluid; to determine, based on the first indication, at least one of: a second gas injection rate, a first period to inject the lift gas with the pump, or a second period, subsequent to the first period, with no injection of the lift gas by the pump, and to cause the pump to operate according to the determination.

In another aspect, a system for injecting lift gas into a wellbore for hydrocarbon production is provided. The system generally includes a pump operable to inject the lift gas into the wellbore; and a processing system coupled to the pump and configured to obtain a first indication of a first liquid production rate of the wellbore; to obtain one or more second indications of second liquid production rates of one or more other wellbores; to determine a first slope, of a first curve relating a plurality of liquid production rates of the wellbore to a plurality of gas injection rates of the wellbore, at a point on the first curve corresponding to the first liquid production rate; to determine one or more second slopes, of one or more second curves, each second curve relating a plurality of liquid production rates of one of the one or more other wellbores to a plurality of gas injection rates of the one of the other wellbores, each second slope being determined at a point on the second curve corresponding to one of the second liquid production rates of the one of the other wellbores; to calculate a weighted average of the first slope and the second slopes, with the weighted average weighted based on the first and second liquid production rates of the wellbore and the other wellbores, respectively; to determine a first gas injection rate such that a third slope, of the first curve, at a point on the first curve corresponding to the first gas injection rate, is equal to the calculated weighted average, and to cause the pump to inject the lift gas into the wellbore at the first gas injection rate.

In another aspect, a system for injecting lift gas into a wellbore for hydrocarbon production is provided. The system generally includes a pump operable to continuously inject the lift gas into the wellbore; and a processing system coupled to the pump and configured to cause the pump to inject the lift gas into the wellbore at a first gas injection rate; to obtain a first indication of a pressure at a location of the wellbore while the pump is injecting the lift gas at the first gas injection rate; to determine, based on the first indication and the first gas injection rate, a second gas injection rate; and to cause the pump to inject the lift gas into the wellbore at the second gas injection rate.

BRIEF DESCRIPTION OF THE DRAWINGS

So that the manner in which the above-recited features of the present disclosure can be understood in detail, a more particular description of the disclosure, briefly summarized above, may be had by reference to aspects, some of which are illustrated in the appended drawings. It is to be noted, however, that the appended drawings illustrate only typical aspects of this disclosure and are therefore not to be considered limiting of its scope, for the disclosure may admit to other equally effective aspects.

DETAILED DESCRIPTION

Aspects of the present disclosure provide techniques and apparatus for measuring one or more parameters associated with a gas lift system for hydrocarbon production and operating the system based on the measured parameters.

Example Gas Lift Unit

Figure 1:
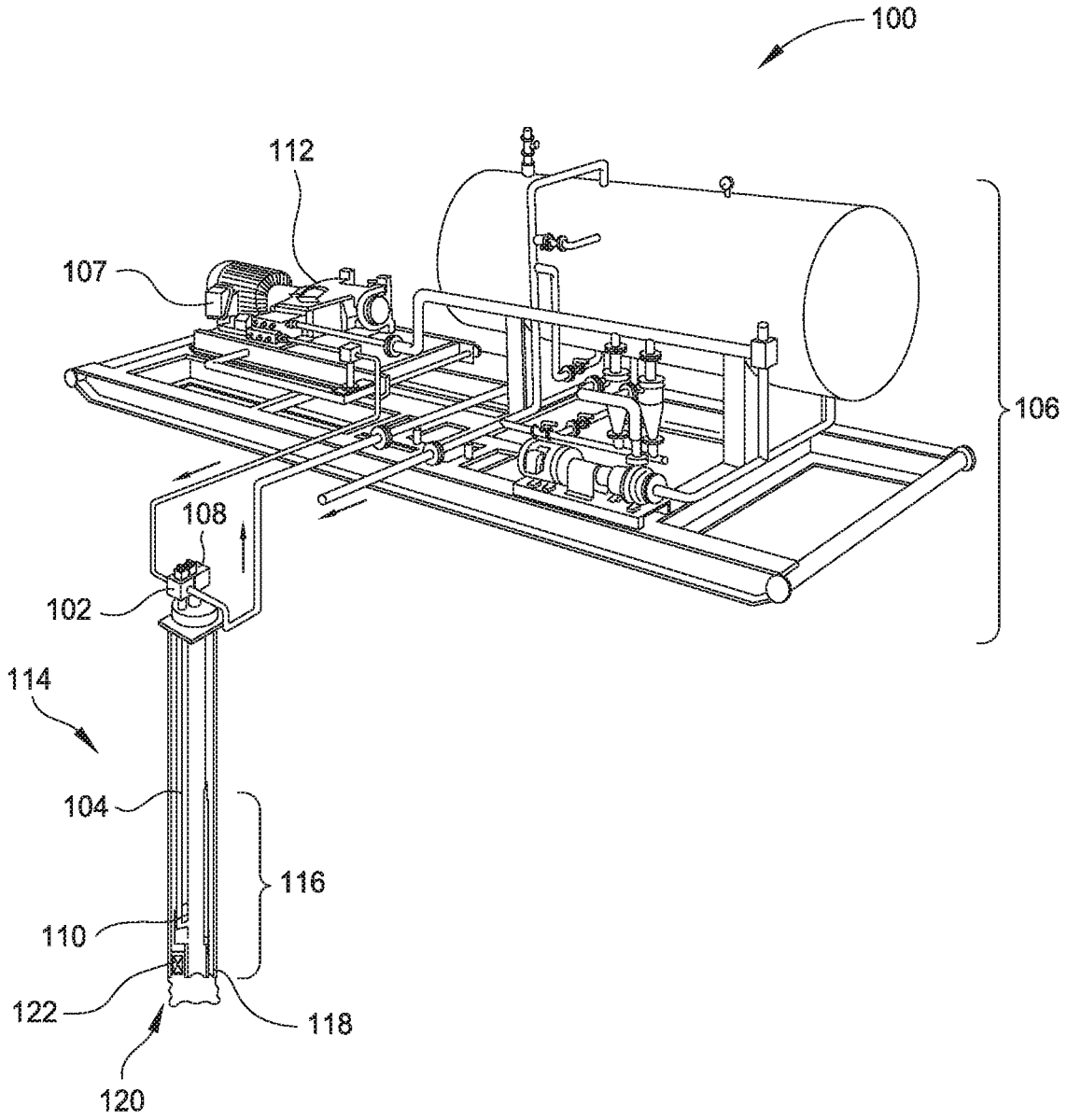
FIG. 1 is a conceptual illustration of an example gas lift system, in accordance with certain aspects of the present disclosure.

FIG. 1 is a conceptual illustration of an example gas lift system 100. The gas lift system 100 includes a wellhead 102 coupled to production tubing 104 disposed in casing 118 downhole in a wellbore 114 and surface machinery 106, generally located at the surface of the wellbore. One or more lift gas valves 122 may be disposed in the casing 118 in a downhole portion 116 of the gas lift system 100, while at the surface, a controller 107 (e.g., a proportional-integral-derivative (PID) controller) and a lift gas pump (e.g., a compressor) 112 may be coupled to the wellhead 102. The controller 107 may comprise one or more processing systems, memory, and input/output devices (e.g., buses, keyboards, display screens) and be operable to control various operations of the gas lift system 100 and the components thereof. One or more sensors 110 may be disposed in the production tubing 104 in a downhole portion 116 of the gas lift system 100 and supply measurements of parameters to the controller 107. Examples of sensors 110 include fiber Bragg gratings (FBGs) in optical waveguides used for measuring temperature and/or pressure and liquid level sensors. In some aspects, the lift gas valves 122 may be injection pressure operated (IPO) valves, for example, that open to allow lift gas to flow into the downhole portion 116 of the wellbore when lift gas pressure is above a threshold level and close to prevent fluid backflow when the lift gas pressure is below the threshold level. In some aspects, the valves may be electromechanical devices controlled by the controller 107. The lift gas pump 112 may be controlled by the controller 107 and may force lift gas down the casing-tubing annulus 120 between the production tubing 104 and the casing 118. The lift gas may return to the surface via the production tubing 104, entraining some liquid from the wellbore and possibly propelling a slug of liquid (e.g., a mass of fluid that is more liquid than gaseous and fills the diameter of the tubing) towards the surface. The liquids, lift gas, and other materials may be separated by a separator at the surface.

The controller 107 may operate the gas lift system 100 by controlling the lift gas pump 112 to start and stop injection of the lift gas. In addition, the controller 107 may be operable to control a gas injection rate of the gas lift system 100 by controlling the lift gas pump 112 to operate at a rate determined by the controller and/or at an output pressure determined by the controller. The controller 107 may also control the gas injection rate by controlling the lift gas valves 122, such as partially closing one or more valves to restrict flow of the lift gas. The controller may also be operable to accept as inputs measurements of pressure at points along the wellbore, liquid levels at points along the wellbore, temperatures at points along the wellbore, and/or quantities of liquids produced from the well.

Gas lift systems may be categorized according to a number of characteristics. One such characteristic is whether a gas lift system runs continuously (e.g., continuously lifted systems) or intermittently (e.g., intermittent lift systems). Another characteristic is whether the gas lift system has constant production measurement, intermittent (e.g., well test) production measurement, or does not have production measurement. Yet another characteristic is whether the gas lift system can supply sufficient lift gas to achieve maximum fluid production from the well or if capacity of the gas lift system is not sufficient to achieve maximum fluid production from the well. For example, a gas lift system may be shared among several wells and be insufficient to achieve maximum fluid production from all of the wells simultaneously.

Figure 2:
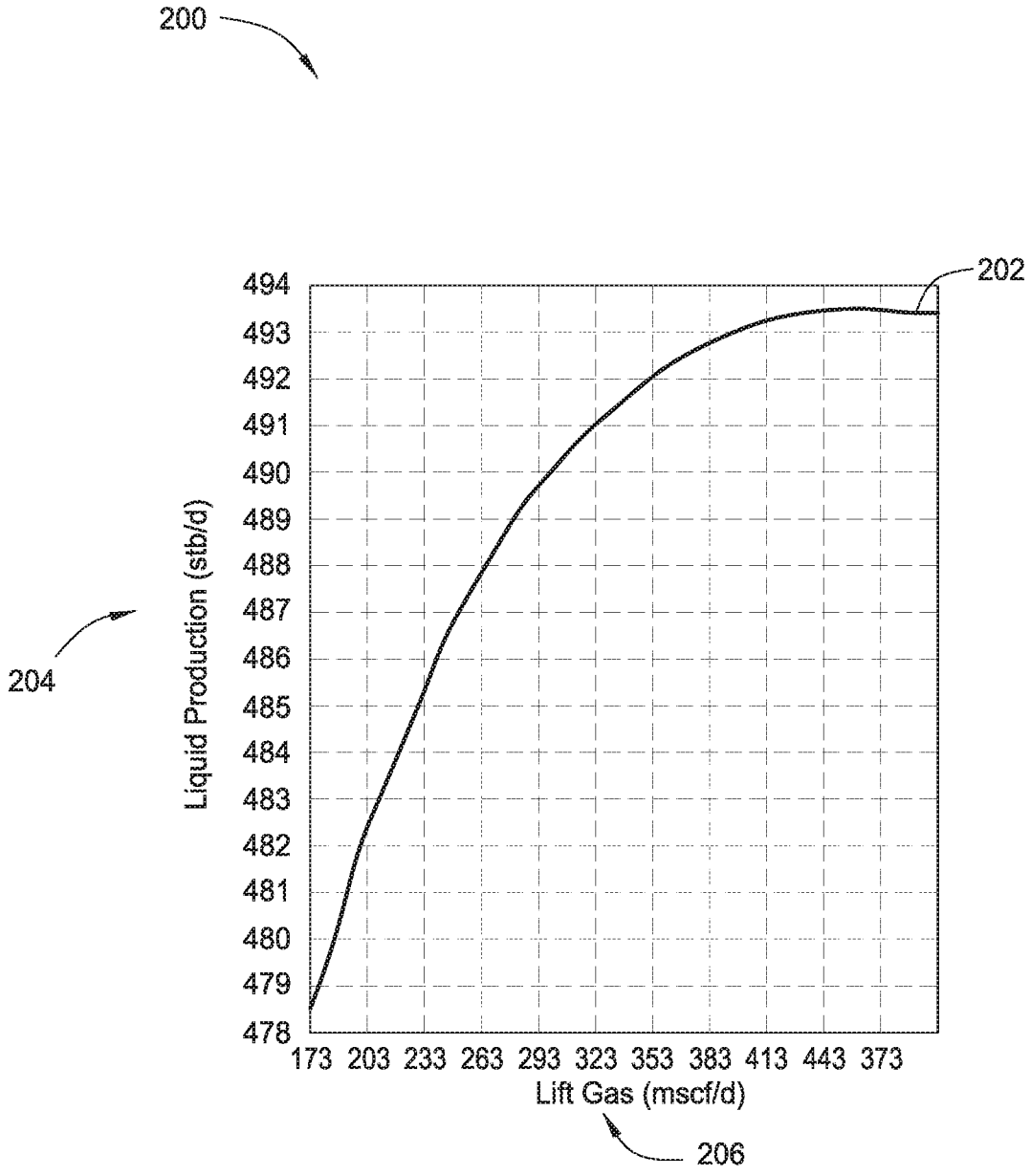
FIG. 2 is an exemplary graph of a performance curve of a gas lift system.

FIG. 2 is an exemplary graph 200 of a performance curve 202 of a gas lift system, such as the gas lift system 100 shown in FIG. 1. Performance of a gas lift well (e.g., a well operated with a gas lift system) may be described by a curve showing a rate of liquid production 204 (in standard barrels per day, for example) versus a rate of lift gas injection 206 (in thousands of standard cubic feet per day, for example). Typically, a curve such as the illustrated curve 202 is calculated based on a sophisticated computerized well model built on past performance of the well and characteristics of the reservoir that the well is tapping. These sophisticated models are typically not available at the well site controller level (e.g., at the controller 107), and can be uneconomical to implement on small groups of wells.

If practically unlimited lift gas supplies are available, the performance curve 202 shown in FIG. 2 can be calculated by periodically adjusting (e.g., on a daily basis) a gas injection rate setpoint of the gas lift system and recording a liquid production rate (e.g., liquid return) for each setpoint.

In a continuously lifted well, the lift gas injection rate may be varied by adjusting a speed or power level of the lift gas pump and/or varying valves controlling the flow of lift gas into the well. Varying the lift gas injection rate typically also alters the liquid production rate of the well (see, e.g., FIG. 2). While the same techniques (e.g., adjusting speed of a lift gas pump or varying valves controlling lift gas flow) may be applied to vary the lift gas injection rate in an intermittently lifted well, it is also common to vary the daily lift gas injection rate (e.g., the quantity of lift gas injected per day) of an intermittently lifted well by adjusting on times and off times of the intermittent gas lift system. That is, the number of times per day that an intermittent lift gas system is on and the durations of those on times are commonly adjusted to adjust the lift gas injection rate and the liquid production of the well.

Figure 3:
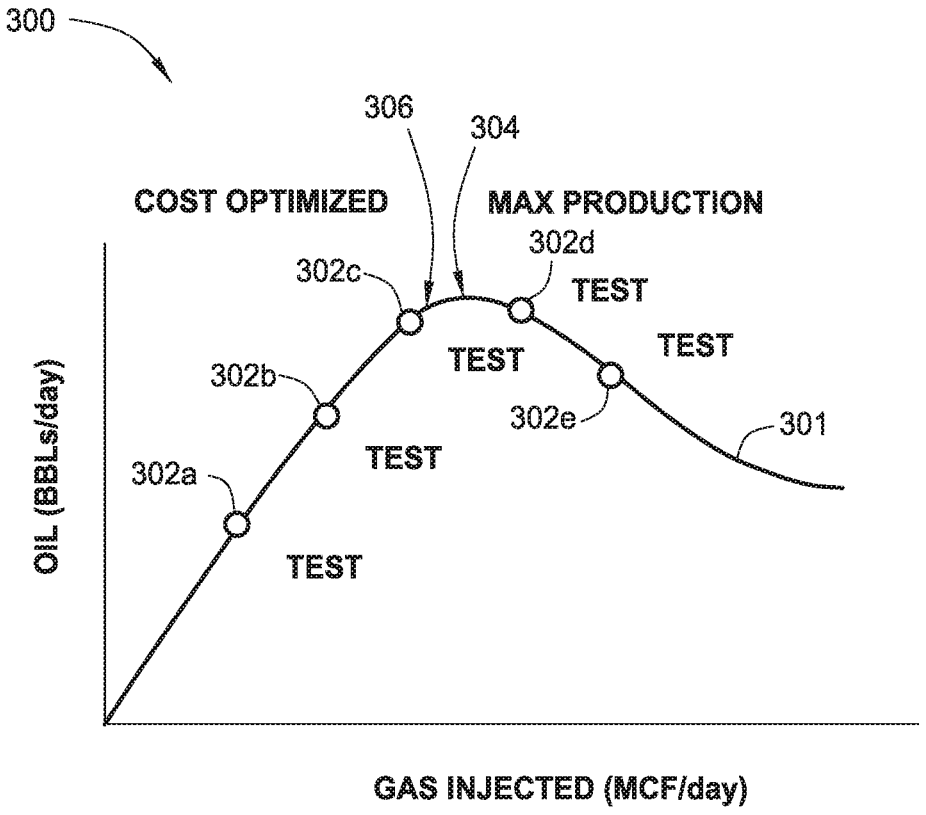
FIG. 3 is an exemplary graph of a performance curve of a gas lift system.

FIG. 3 is an exemplary graph 300 illustrating an exemplary performance curve 301 of a gas lift system determined by adjusting a gas injection rate setpoint and recording a corresponding oil production rate. Each of the points 302*a-e* is representative of operation of a gas lift system of a well at a particular rate of gas injection (in thousands of cubic feet (MCF)/day) and a corresponding rate of oil production (in barrels per day) from the well. As mentioned above, gas lift systems often involve an investment to implement and have an associated cost of operation. Thus, a curve such as the curves shown in FIG. 2 and FIG. 3 may be representative of an economic return of a gas lift system at a well. In constructing the curve 301 shown in FIG. 3, a point 304 of maximum production from the well may be determined. However, the maximum production point may be different from the point 306 where the cost per barrel of oil produced is optimized (e.g., the cost to produce each barrel of oil is minimized, considering both capital investment and operating expenses of a well or group of wells).

Example Algorithm Strategy

According to aspects of the present disclosure, a processing system (e.g., controller 107, shown in FIG. 1) may perform an algorithm to determine performance curves similar to those shown in FIGS. 2-3 for a gas lifted well or group of gas lifted wells that are controlled by the processing system. An exemplary algorithm strategy may begin with a user setting a test period (e.g., 24 hours) for the processing system to use in carrying out tests. The user may also set a test frequency (e.g., fourteen days or a month), which the processing system uses to determine how often to run a test series on the well (see below). The processing system follows the algorithm to run the well or wells through a course of injection rate setpoint adjustments and records the oil return per test period (e.g., 24 hours), until the processing system finds a desirable setpoint. The desirable setpoint may correspond to a maximum liquid production rate (see, e.g., point 304 on FIG. 3) of the well or wells, an optimal cost per barrel (see, e.g., point 306 on FIG. 3) of the well or wells, or be considered desirable due to other considerations. The processing system following the algorithm then maintains that setpoint (e.g., causes the gas lift system to run at that injection rate) until a next testing period is to occur according to the test frequency setpoint. That is, when the test frequency has elapsed, the processing system begins a new test, starting with the desirable setpoint from the previous test and control parameters generated during the previous test.

According to aspects of the present disclosure, performance curves similar to those shown in FIGS. 2 and 3 for a gas lifted well or group of gas lifted wells may be determined from production data (e.g., data regarding quantities of oil produced) of the well(s). The production data may be obtained from systems that continuously monitor the well(s) and/or from well testing systems. Well testing systems may be disruptive of production from a well, and thus may not provide production data continuously. Instead, well testing systems may provide data on an intermittent schedule or may provide production data regarding one well in a group. Well testing systems may provide production data for each well in a group, taking the wells in turn. Scheduling of the performance of the algorithm described above, by a processing system, may take into account whether a well testing system provides production data intermittently and/or a schedule followed by a well testing system.

According to aspects of the present disclosure, production data from monitoring systems and/or well testing systems may not be available for some gas lifted wells. A processing system (e.g., controller 107 shown in FIG. 1) may determine a performance curve relating pressure at a location of the well (e.g., a bottom-hole pressure (BHP) to lift gas injection rates (see, e.g., FIG. 5) for a gas lifted well based on data obtained from a sensor and/or data regarding lift gas injection rates and lift gas injection pressures that the processing system obtains from sensors and/or a lift gas pump (e.g. lift gas pump 112 shown in FIG. 1) and/or lift gas valves (e.g. lift gas valve 122 shown in FIG. 1). As described in more detail below, a curve relating pressure at a location of a well to lift gas injection rate may be used to determine a desirable setpoint of a gas lift well.

Aspects of the present disclosure provide methods and apparatus for improving the operation of gas lift systems with processing systems proximate to the gas lift systems. Lift gas injection rates, on times, and/or off times (collectively operating parameters or setpoints) of both continuously operated and intermittently operated gas lift systems may be determined by the processing systems that respond to data regarding changes in performance of the well that may have been caused by previous changes in operating parameters. The processing systems may determine one or more responses (e.g., changes to operating parameters) to well performance data collected (e.g., at least daily) to more economically operate wells using such gas lift systems, according to aspects of the present disclosure.

According to aspects of the present disclosure, a processing system (e.g., a controller, such as controller 107) may cause lift gas to flow into a well at a first gas injection rate, may obtain data regarding fluid production from the well, and may then adjust the gas injection rate in an effort to improve the fluid production of the well. A controller may perform these operations in an iterative fashion to improve fluid production at a well for which the controller is able to obtain real-time or daily gas injection and fluid production data.

According to aspects of the present disclosure, a processing system (e.g., a controller) may cause lift gas to flow into a well at a first gas injection rate; may obtain data regarding fluid production from the well, costs of the lift gas injection, and value of the fluids; and may then adjust the gas injection rate to improve the profitability of fluid production of the well. A controller may perform these operations in an iterative fashion to improve profitability at a well for which the controller is able to obtain real-time or daily gas injection and fluid production data.

A gas injection rate corresponding to a highest liquid (e.g., oil) production rate may be determined by choosing a spread of test points for a gas lift system and finding the highest liquid production rate among the test points. The gas lift system may then be operated at that gas injection rate. However, according to aspects of the present disclosure, instead of operating at a test point having a highest liquid production rate, an adjustment of a setpoint (e.g., a gas injection rate, an on time of an intermittent gas lift system, and/or an off time of an intermittent gas lift system) may be determined based on a change in liquid production rate caused by a previous change of a setpoint. Changes to setpoints of a gas lift system may be determined based on current and/or recent production measurements and/or other parameters.

According to aspects of the present disclosure, a processing system (e.g., controller 107 shown in FIG. 1) may perform a proportional-integral-derivative (PID) algorithm to determine a setpoint (e.g., a gas injection rate) corresponding to a point on a performance curve having a desired performance (e.g., in terms of barrels of oil produced per thousands of cubic feet of lift gas injected). That is, changes to a setpoint determined by a controller may be calculated by summing a first term proportional to a difference between a current setpoint and a desired setpoint, a second term proportional to an integral of previous changes, and a third term proportional to the current rate of change (e.g., derivative) of the performance curve. Other aspects may use any one or any combination of the proportional, integral, and/or derivative values.

In some wells, a lift gas source may not be capable of supplying lift gas at a rate high enough to determine a highest liquid production rate. According to aspects of the present disclosure, a processing system may determine a lift gas injection rate for the well that causes liquid production at a rate that is more profitable than other gas injection rates.

Example Equal Slopes Technique

According to aspects of the present disclosure, a performance curve similar to curve 202 shown in FIG. 2 and curve 301 shown in FIG. 3 for a group of wells that share a lift gas source may be determined. In a group of wells sharing a lift gas source, a processing system (e.g., controller 107 shown in FIG. 1) may determine a performance curve for the group of wells by summing production data for the wells at various injection rates and/or determining weighted averages based on the production data for the wells at the various injection rates. A desirable setpoint for the group of wells may be determined (e.g., by the processing system) based on the performance curve for the group of wells. A desirable slope of the performance curve for the group of wells may be determined based on the determined desirable setpoint for the group of wells. A setpoint for any well in the group of wells may then be determined (e.g., by the processing system) by finding a point on a performance curve for that well that has a same slope as the desirable slope for the group of wells. The processing system may determine a setpoint for each of the wells in the group of wells by finding a point on a performance curve of each well with a same slope as the desirable slope for the group of wells. This technique may be referred to as an "equal slopes" technique or "equal slopes" method.

According to aspects of the present disclosure, a processing system (e.g., controller 107 shown in FIG. 1) may determine a setpoint for a gas lift system (e.g., gas lift system 100) of a well by determining a slope at a desired operating point on a first curve relating liquid production rates to lift gas injection rates for a group of wells and then determining a point, on a second curve relating liquid production rates to lift gas injection rates for the well, where the second curve has the same slope as the first curve at the desired operating point.

Figure 4:
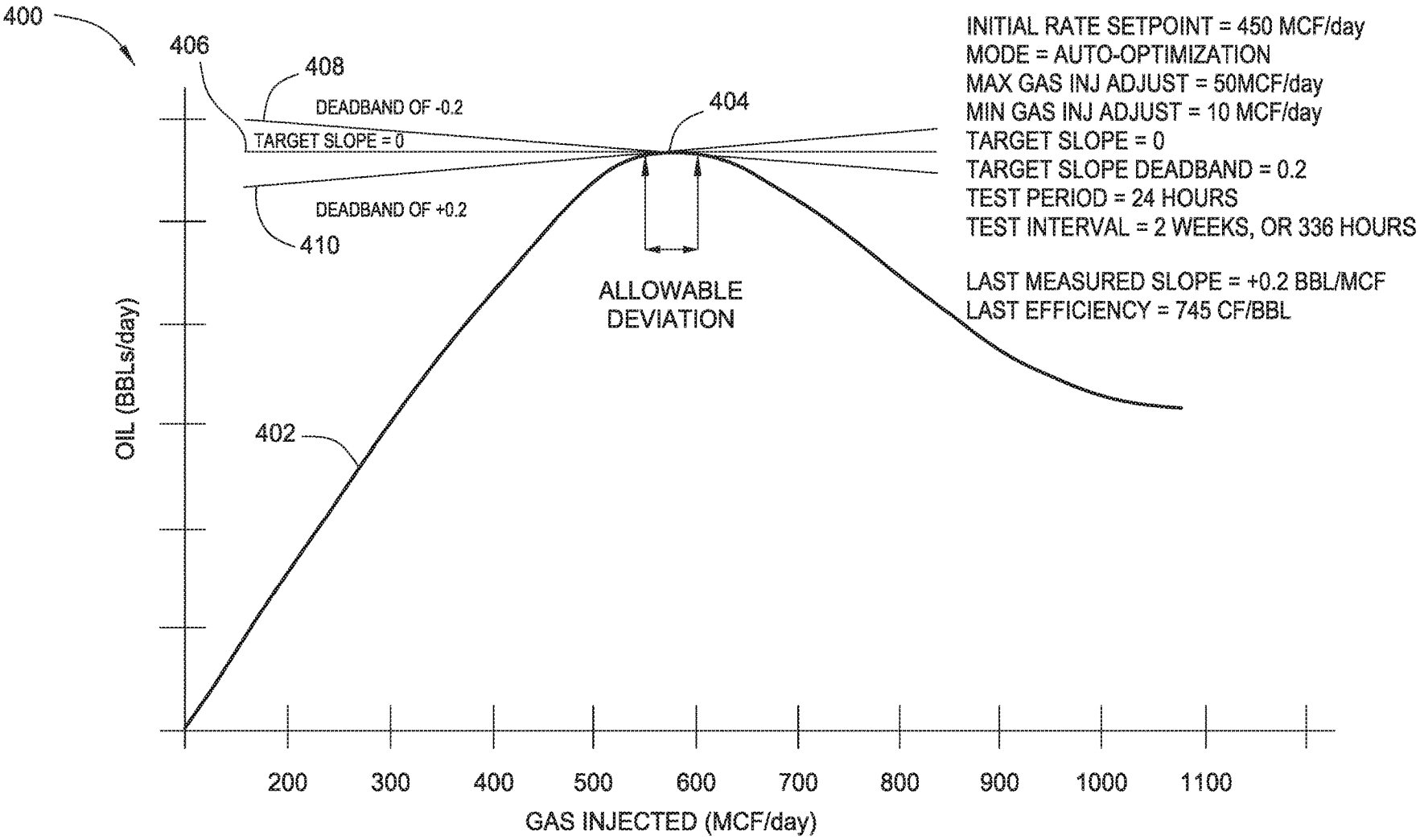
FIG. 4 is an exemplary graph relating a liquid (e.g., oil) production rate to a lift gas injection rate of an exemplary well.

FIG. 4 shows an exemplary graph 400 with a curve 402 relating a liquid (e.g., oil) production rate to a lift gas injection rate of an exemplary well. In the exemplary well, a target production point (e.g., a lift gas injection rate producing oil at a target rate) of the gas lift system is located at 404. The slope of the curve at the target production point may be referred to as a target slope. In the curve 402, the slope of the curve at the target production point 404 is zero, indicating a maximum. The line 406 intersects the target production point 404 of the curve 402 and has the same slope (i.e., zero) as the curve. In the exemplary well, an allowable deviation of ±0.2 from the target slope of 0 has previously been determined. Lines 408 and 410 pass through the target production point 404 and are representative of the "deadband" (also referred to as a "guard band"), because line 408 has a slope of −0.2 and line 410 has a slope of 0.2. Determining not to alter a setpoint when current production is within an allowable deviation of a target production point enables a well controller (e.g., controller 107, shown in FIG. 1) to stop making adjustments (e.g., to setpoints) that may be disruptive of ongoing production of the well. Measuring a slope of a line connecting a previous setpoint to a current setpoint enables a processing system (e.g., a controller) to determine if current production is within the allowable deviation of the target production point.

According to aspects of the present disclosure, whether to change a current setpoint of a gas lift system may be determined (e.g., by a processing system) based on a slope of a line between the current setpoint and a previous setpoint, on a graph relating a liquid production rate to a lift gas injection rate. The determination may be to continue operating using a current setpoint (i.e., leaving the setpoint unchanged) if the slope of the line between the current setpoint and the previous setpoint is approximately equal to a target slope, within an allowable deviation or deadband quantity. That is, whether to change a setpoint may be determined based on how close a slope associated with a previous change is to a target slope.

In some locations, a lift gas source (e.g., machinery to supply lift gas, such as the surface machinery 106 shown in FIG. 1) may be shared among a group of wells. When a lift gas source is shared among a group of wells, the lift gas source may not be capable of supplying sufficient lift gas to all of the wells in the group to cause maximum liquid production from all of those wells. According to aspects of the present disclosure, a lift gas injection rate for a well in such a group may not be set at a rate that causes maximum liquid production from the well. A lift gas injection rate for such a well may be determined (e.g., by a processing system proximate to the lift gas source) in an iterative fashion according to aspects of the present disclosure, by following the algorithm described below with reference to FIG. 8.

Example Pressure Adjustment Technique

According to aspects of the present disclosure, as a rate of gas injection into a gas lift well increases, the casing pressure and bottom-hole pressure of the well decrease until minimum values of these pressures are reached. If gas is injected into the well above the rate at which the minimum values of these pressures occur, then all of the injected gas is unable to flow through the lift gas valve and these pressures begin to rise again. Injecting gas into a well faster than the gas can flow through the lift gas valve may be referred to as "packing the casing."

Figure 5:
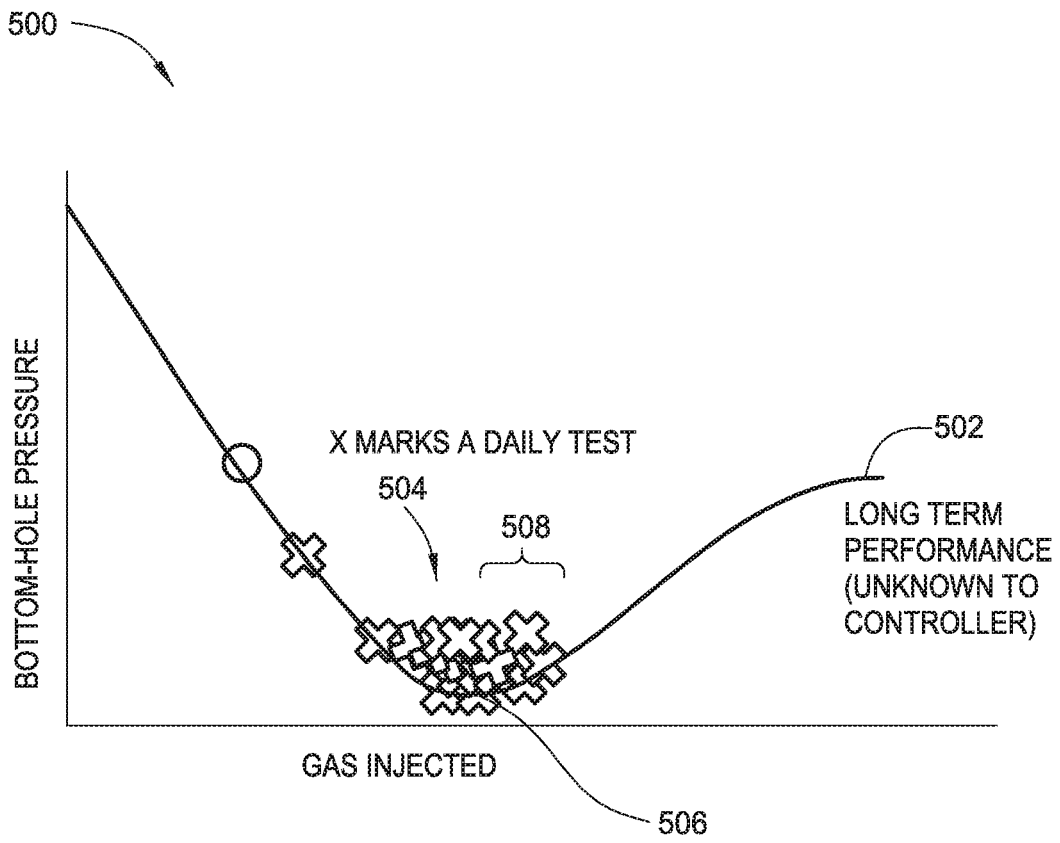
FIG. 5 is an exemplary graph relating bottom-hole pressure of a wellbore to gas injection rates.

FIG. 5 shows an exemplary graph 500 with a curve 502 relating bottom-hole pressure (BHP) of a wellbore to gas injection rates (e.g., gas injected per day). A number of test points of daily tests are shown at 504 and represented with an "X" in the graph 500. As described above, the minimum bottom-hole pressure corresponds to a particular rate of gas injection, at point 506. Thus, rates of gas injection higher than the rate at point 506 actually cause the bottom-hole pressure to increase, as seen in the region 508.

According to aspects of the present disclosure, a lift gas injection rate that minimizes casing or bottom-hole pressure of a well may be considered an optimum lift gas injection rate for that well. That lift gas injection rate may cause a maximum liquid production rate (see, e.g., FIGS. 2 and 4), while a lower gas injection rate may cause a lower liquid production rate and a higher gas injection rate will not increase the liquid production rate but will typically involve higher expenses for the same or a lower liquid production rate.

According to aspects of the present disclosure, a processing system (e.g., a controller) may cause lift gas to flow into a well at a first gas injection rate, may obtain data regarding a casing pressure or bottom-hole pressure of the well, and may then adjust the gas injection rate to reduce the casing pressure or bottom-hole pressure (BHP) of the well. Adjusting the gas injection rate based on the casing pressure or BHP may be referred to as interpolating the casing pressure or bottom-hole pressure. A controller may perform these operations in an iterative fashion to improve fluid production at a well for which the controller is able to obtain, for example, real-time or daily casing pressure or bottom-hole pressure data.

According to aspects of the present disclosure, a processing system (e.g., a controller) may cause lift gas to flow into a well at a first gas injection rate; may obtain data regarding a casing pressure or bottom-hole pressure of the well, costs of the lift gas injection, and value of fluids from the well; and may then adjust the gas injection rate to improve the profitability of fluid production of the well. A controller may perform these steps in an iterative fashion to improve profitability at a well for which the controller is able to obtain, for example, real-time or daily casing pressure or bottom-hole pressure data.

The Thornhill-Craver orifice flow equation relates flow rate through an orifice valve to pressure, temperature, and other parameters. The equation is reproduced below:

$$q_{g,sc}=693C_d d^2 p_1\sqrt{(1/(\gamma_g T_1))}\sqrt{(2\kappa/(\kappa+1))}\sqrt{((p_2/p_1)^{(2/\kappa)}-(p_2/p_1)^{((\kappa+1)/\kappa)})}$$

where: $q_{g,sc}$=flow rate at standard conditions (14.7 psia and 60° F.), thousands of standard cubic feet per day (Mscf/d)
$C_d$=discharge coefficient
d=choke diameter, inches (in.)
$p_1$=flowing pressure upstream of the choke, psia
$p_2$=flowing pressure downstream of the choke, psia
$\gamma_g$=specific gravity of the gas
$T_1$=absolute temperature upstream of the choke, ° R
κ=ratio of specific heats According to aspects of the present disclosure, a processing system (e.g., a controller) may calculate pressure (e.g., flowing pressure downstream of the choke) at a location of a gas lift valve by obtaining a measurement of gas flow into the gas lift valve, discharge coefficient of the gas lift valve, choke diameter, flowing pressure upstream of the choke, specific gravity of the gas, temperature upstream of the choke, and a ratio of specific heats, and then solving the Thornhill-Craver equation for the flowing pressure downstream of the choke.

Another equation relates flow through an IPO valve to pressure, temperature, and other parameters. This equation is reproduced below:

$$q_{sc}=1241A_v C_d Y\sqrt{((p_i(p_i-p_p))/(T_v Z_v \gamma_g))}$$

where: $q_{sc}$=gas flow rate at standard conditions, Mscf/d
$A_v$=port area, sq. in.
$C_d$=discharge coefficient including the ratio of areas
Y=expansion factor
$p_i$=injection pressure at valve setting depth, psia
$p_p$=production pressure at valve setting depth, psia
$T_v$=valve temperature, ° R
$Z_v$=gas deviation factor at valve setting depth
$\gamma_g$=specific gravity of the gas According to aspects of the present disclosure, a processing system (e.g., a controller) may calculate pressure (e.g., production pressure at valve setting depth) at a location of a gas lift valve by obtaining a measurement of gas flow into the gas lift valve, discharge coefficient of the gas lift valve including the ratio of areas, port area of the gas lift valve, injection pressure at valve setting depth, production pressure at valve setting depth, valve temperature, gas deviation factor at valve setting depth, and specific gravity of the gas, and then solving the equation above for the gas flow rate (at standard conditions).

According to aspects of the present disclosure, a processing system (e.g., a controller 107, shown in FIG. 1) may cause lift gas to flow into a well at a first gas injection rate, may calculate a pressure (e.g., a flowing pressure downstream of a choke or a production pressure at valve setting depth) in a well based on other parameters, as described above, and may then adjust the gas injection rate to minimize the calculated pressure. A processing system may perform these steps in an iterative fashion to improve fluid production at a well for which the processing system is unable to obtain real-time or daily production data.

According to aspects of the present disclosure, a gas injection rate, an on time of an intermittent gas lift system, and/or an off time of an intermittent gas lift system may be determined (e.g., by a processing system controlling the intermittent gas lift system) based on an indication of a pressure at a location of a wellbore, for example, a bottom-hole pressure or a casing pressure.

In a well using an intermittent gas lift system, the casing-tubing annulus may be kept charged to a maximum pressure by using a lift gas injection rate high enough to detect that lift gas is flowing through the lift gas valve(s), but at a minimal rate. This may be similar to supplying gas at pressure to a bubble tube, commonly used to detect liquid level in industrial tanks. In a bubble tube, the pressure required to cause bubbles to enter the liquid at the bottom of the tube is directly related to the height of the liquid level above the bottom of the tube. Because the gas is flowing at a minimal rate, the pressure at the bottom of the bubble tube may be considered equal to the pressure at which the gas is supplied to the bubble tube. The described minimal lift gas flow may be maintained (i.e., by supplying gas at pressure) between "on times" of higher lift gas flow rates.

According to aspects of the present disclosure, a processing system may control an intermittent gas lift system to inject gas into a well at a minimal rate, as described above, to keep a casing-tubing annulus of the well charged to a maximum pressure. The processing system may determine, based on a timer, arrival of a fluid at a wellhead, or an indication of a parameter (e.g., a temperature, a pressure, a fluid composition at a wellhead) to change the gas injection rate to a higher value for an on cycle. The processing system may determine a duration of an on cycle based on past performance of the well or an indication of a parameter and may reduce the gas injection rate to the minimal rate once the determined duration of the on cycle has occurred.

According to aspects of the present disclosure, injection of lift gas into a gas lift well may cause a slug of liquid to be delivered to the wellhead. The lift gas may push liquid from the bottom of the well into the tubing, forcing the liquid up the tubing to the wellhead. The liquid may contain gases from the reservoir and/or lift gas, which may bubble through the liquid. A separator at or near the wellhead may be used to separate the liquid from the gases. In some cases, the lift gases may be recycled and used as lift gas again.

Figure 6:
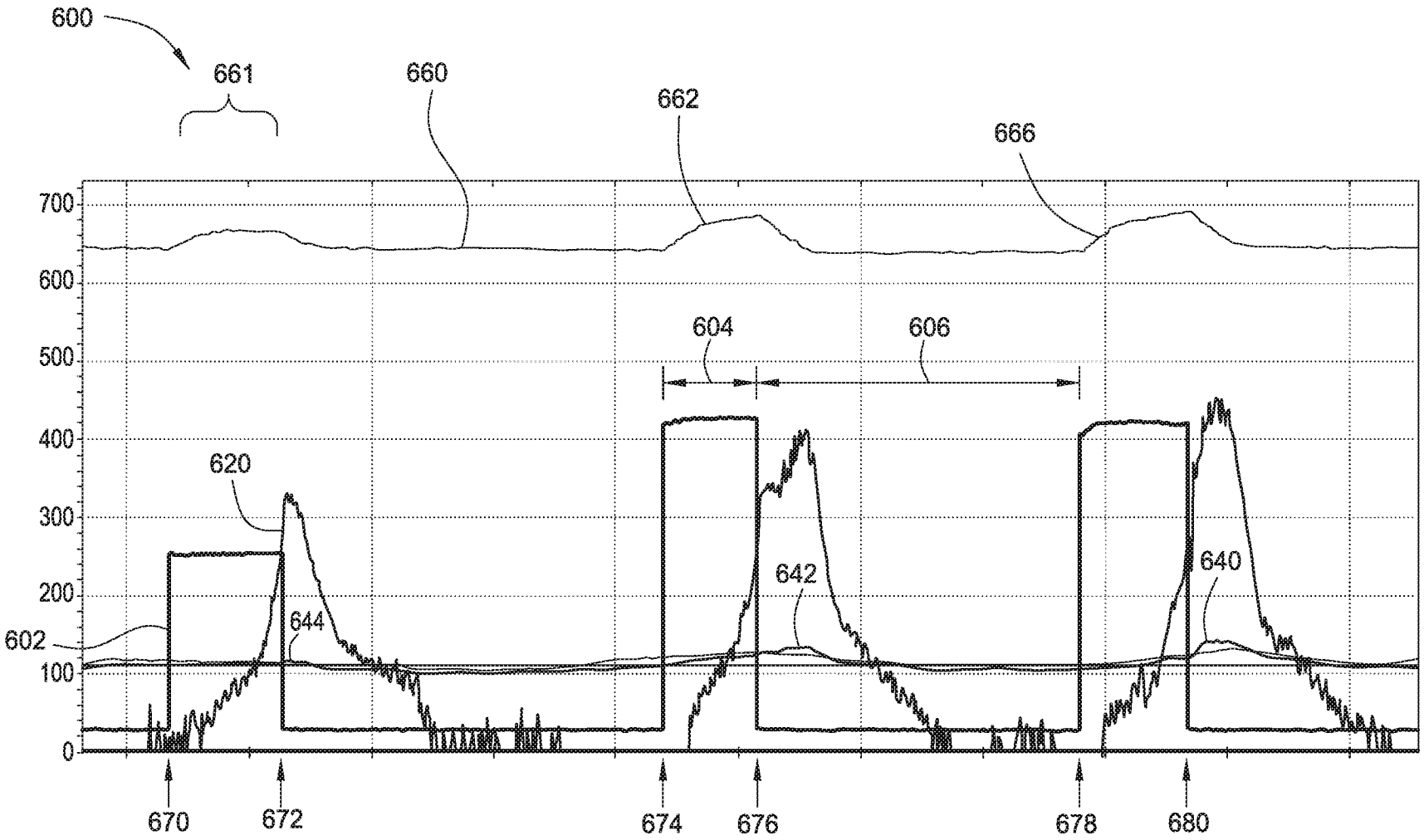
FIG. 6 illustrates variations in liquid flow rate measurements indicative of slug flow.

FIG. 6 is an exemplary chart 600 of measurements of parameters in an exemplary intermittently operated gas lifted well, according to aspects of the present disclosure. The exemplary chart 600 includes a lift gas injection rate curve 602, a liquid production rate curve 620, a tubing pressure curve 640, and a casing pressure curve 660. As can be seen from the gas injection rate curve 602, lift gas injections begin (e.g., on times 604 of the intermittent gas lift system begin) at start times 670, 674, and 678. The lift gas injections end (e.g., off times 606 of the intermittent gas lift system begin) at stop times 672, 676, and 680. The exemplary chart 600 illustrates variations in the measured parameters that may be indicative of slug flow. For example, the increases in the tubing pressure shown at 640 and 642 are indicative of a slug of fluid being forced up the tubing by the injection of the lift gas. The tubing pressure at 644 stays near the average tubing pressure, indicating that no slug of fluid is being forced up the tubing. Similarly, the sharp increases in the liquid production rates shown at times 676 and 680 are due to slugs arriving at the wellhead. The peak in liquid production starting at 672 is both lower and narrower, again indicating that no slug of fluid was forced up the tubing by the on time 604 starting at 670.

According to aspects of the present disclosure, a change in a slope (e.g., a "knee") of a curve representing casing pressure, as shown at 662 and 666 in the casing pressure curve 660, may indicate that a lift gas injection rate is sufficient to charge a casing tubing annulus. Charging the casing-tubing annulus may be associated with starting liquid production from a well, as shown. The lift gas injection rate of the on time 604 starting at 670 may not be high enough to charge the casing tubing annulus, as indicated by the lack of a knee in the casing pressure curve 660 in the region 661.

According to aspects of the present disclosure, a processing system (e.g., controller 107 shown in FIG. 1) may cause lift gas to flow into a well at a first gas injection rate, may obtain an indication regarding presence of a slug in tubing of the well (e.g., a knee in a curve of casing pressure) or of arrival of the slug at a wellhead (e.g., a rise in tubing pressure of the well), and may then adjust the gas injection rate, a start time for a next on time, and/or a length of a next off time to improve liquid production of the well. For example, a processing system may determine that a slug of fluid was not produced during an on time and raise a gas injection rate at a next on time and/or extend a length of the off time immediately following the on time. In a second example, a processing system may determine that a slug of fluid was produced during an on time and decrease a length of the off time immediately following the on time. A processing system may perform these operations in an iterative fashion to improve liquid production at a well for which the processing system is able to obtain, for example, real-time or daily tubing pressure data.

According to aspects of the present disclosure, a processing system (e.g., controller 107, shown in FIG. 1) may cause lift gas to flow into a well at a first gas injection rate; may obtain an indication regarding presence of a slug in tubing of the well (e.g., a knee in a curve of casing pressure) or of arrival of the slug at a wellhead (e.g., a rise in tubing pressure of the well), costs of the lift gas injection, and value of fluids from the well; and may then adjust the gas injection rate, a start time for a next on time, and/or a length of a next off time in an effort to improve the profitability of fluid production of the well. A processing system may perform these operations in an iterative fashion to improve profitability at a well for which the processing system is able to obtain, for example, real-time or daily casing pressure or bottom-hole pressure data.

Figure 7:
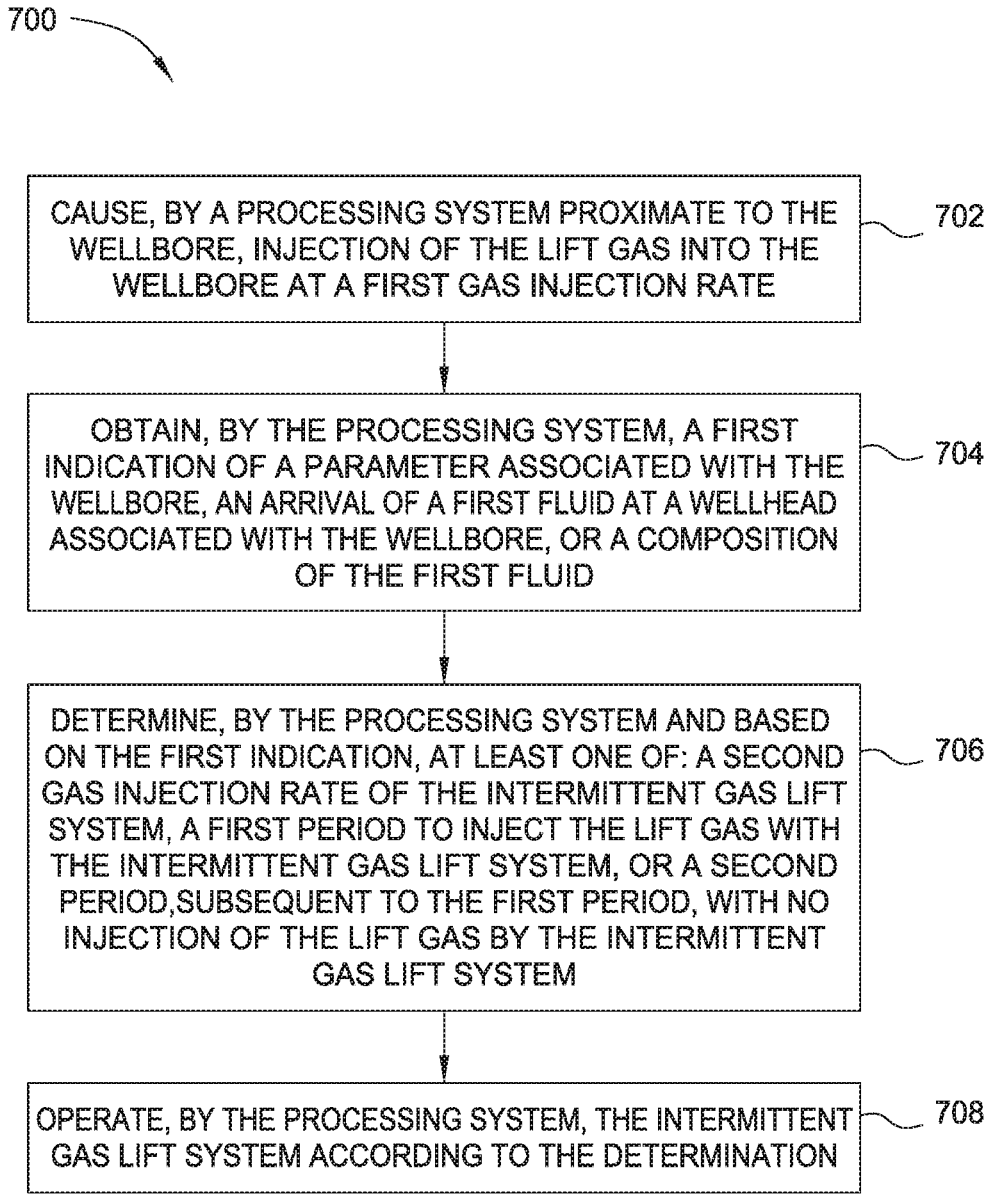
FIG. 7 is a flow diagram of example operations for operating an intermittent gas lift system, in accordance with certain aspects of the present disclosure.

FIG. 7 illustrates example operations 700 for operating an intermittent gas lift system operable to inject lift gas into a wellbore for hydrocarbon production, in accordance with certain aspects of the present disclosure. Operations 700 begin at block 702 with causing, by a processing system proximate to the wellbore, injection of the lift gas into the wellbore at a first gas injection rate. For example, controller 107 (e.g., a processing system) shown in FIG. 1 may cause a lift gas pump 112 to inject lift gas into the wellbore at a first gas injection rate.

At block 704, operations 700 continue with obtaining, by the processing system, a first indication of a parameter associated with the wellbore, an arrival of a first fluid at a wellhead associated with the wellbore, or a composition of the first fluid. Continuing the example, the controller 107 may obtain an indication of a casing pressure from a sensor 110.

At block 706, operations 700 continue with determining, by the processing system and based on the first indication, at least one of: a second gas injection rate of the intermittent gas lift system, a first period to inject the lift gas with the intermittent gas lift system, or a second period, subsequent to the first period, with no injection of the lift gas by the intermittent gas lift system. Continuing the example, the controller 107 may determine a first period (e.g., two hours and fifteen minutes) to inject the lift gas with the lift gas pump 112.

At block 708, operations 700 conclude with operating, by the processing system, the intermittent gas lift system according to the determination. Continuing the example, the controller 107 may cause the lift gas pump 112 to stop injecting lift gas at the end of the first period. In the example, the controller 107 may cause the lift gas pump 112 to shut down or operate one or more lift gas valves 122 to stop the flow of lift gas into the wellbore.

According to aspects of the present disclosure, the processing system determine the second gas injection rate, cause injection of the lift gas into the wellbore at the second gas injection rate, cause the injection of the lift gas to stop, determine the first period, and cause the injection of the lift gas to start during the first period.

In some aspects of the present disclosure, the processing system may obtain a liquid production rate from the wellbore, determine the second period, and cause the injection of the lift gas to stop during the second period. The processing system may start a timer upon stopping the injection of the lift gas and then restart the injection of the lift gas when the timer expires. Additionally or alternatively, the processing system may obtain an indication of a liquid level at a location of the wellbore (e.g., at a point in the casing-tubing annulus 120, shown in FIG. 1) and restart injection of the lift gas, based on the indicated liquid level.

According to aspects of the present disclosure, the processing system may obtain an indication of a first pressure at a location of the wellbore, determine the second period based on the indication of the first pressure, and stop injection of the lift gas during the second period. The first pressure may comprise a bottom-hole pressure (BHP) or a casing pressure of the wellbore. The processing system may then obtain a second indication of a second pressure at the location, determine to restart the injecting of the lift gas based on the second indication, and restart the injecting of the lift gas. For example, the controller 107, shown in FIG. 1, may cause the lift gas pump 112 to inject lift gas into the wellbore 114, obtain a first indication from a sensor 110 that a bottom-hole pressure (BHP) is equal to or greater than a first threshold, determine a second period to stop the injection, and cause the lift gas pump 112 to stop the injection during the second period. Continuing the example, the controller 107 may later obtain a second indication from the sensor 110 that the BHP is below the first threshold or a second threshold, determine to restart the injection of the lift gas based on the second indication, and cause the lift gas pump 112 to restart injection of the lift gas.

According to aspects of the present disclosure, the processing system may cause injection of lift gas at the first lift gas injection rate, obtain a measurement of a first liquid production rate while the injection of the lift gas at the first lift gas injection rate is ongoing, determine the second lift gas injection rate, cause injection of the lift gas into the wellbore at the second lift gas injection rate, and obtain a measurement of a second liquid production rate while the injection of the lift gas at the second lift gas injection rate is ongoing. The processing system may then determine a third lift gas injection rate based on the first lift gas injection rate, the first liquid production rate, the second lift gas injection rate, and the second liquid production rate (e.g., by determining if a slope between points corresponding to the first and the second liquid production rates on a curve relating liquid production gas injection rates is within a deadband of a target slope) and cause injection of the lift gas into the wellbore at the third lift gas injection rate.

In aspects of the present disclosure, the processing system may obtain an indication that the first fluid (arriving at the wellhead as described with reference to FIG. 7) is more gas than liquid, determine to set the second gas injection rate to a value greater than the first gas injection rate based on the indication, and cause injection of the lift gas into the wellbore at the second gas injection rate.

According to aspects of the present disclosure, the processing system may obtain a first indication that the first fluid (arriving at the wellhead as described with reference to FIG. 7) is more liquid than gas, determine to set the second gas injection rate to a value equal to or greater than the first gas injection rate based on the first indication, obtain a second indication that a second fluid arriving at the wellhead subsequent to the first fluid is more gas than liquid, reset the second gas injection rate to a value less than the first gas injection rate based on the second indication, and cause injection of the lift gas into the wellbore at the second gas injection rate.

In aspects of the present disclosure, the processing system may cause injection of lift gas into the wellbore at a first injection rate, obtain an indication of arrival of the first fluid at the wellhead, determine the first period based on the indication, stop the injection of the lift gas at the end of the first period, start a timer at the end of the first period, and cause injection of the lift gas to restart upon expiration of the timer.

According to aspects of the present disclosure, the processing system may cause injection of lift gas into the wellbore at a first injection rate, obtain an indication of a casing pressure associated with the wellbore, and determine the first period based on the first gas injection rate, a depth of the wellbore, and the casing pressure. The processing system may then stop the injection of the lift gas at the end of the first period.

In aspects of the present disclosure, the processing system may cause injection of lift gas into the wellbore at a first injection rate, obtain an indication of a casing pressure associated with the wellbore, and determine the second gas injection rate based on the casing pressure and a liquid production rate at the wellhead. The processing system may then cause injection of the lift gas into the wellbore at the second gas injection rate.

Figure 8:
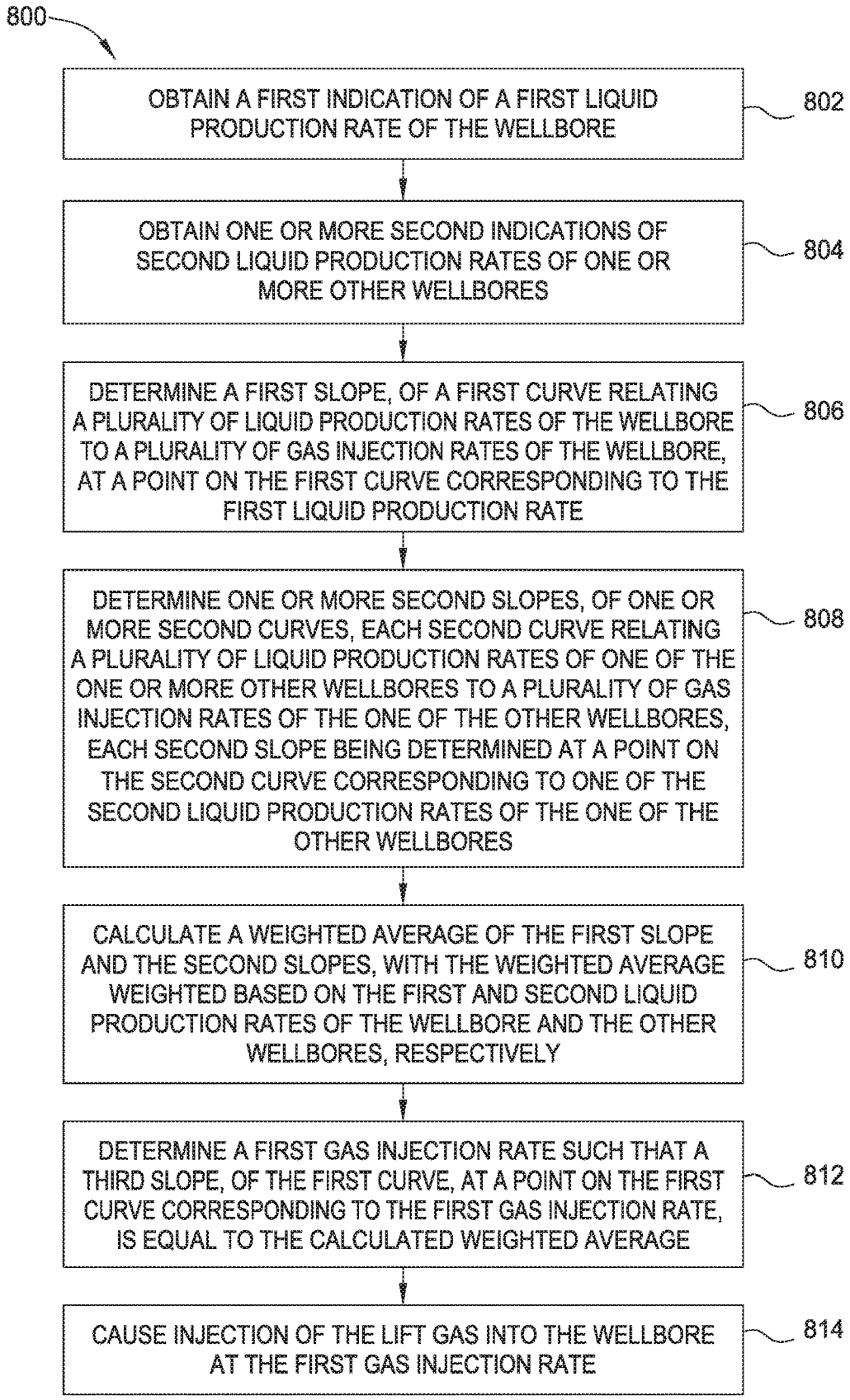
FIG. 8 is a flow diagram of example operations for operating a gas lift system, in accordance with certain aspects of the present disclosure.

FIG. 8 illustrates example operations 800 for operating a gas lift system operable to inject lift gas into a wellbore for hydrocarbon production, in accordance with certain aspects of the present disclosure. The gas lift system of FIG. 8 may be an intermittent gas lift system or a continuous gas lift system.

Operations 800 begin at block 802 with obtaining a first indication of a first liquid production rate of the wellbore. For example, controller 107, shown in FIG. 1, may obtain a first indication of a first liquid production rate of the wellbore, for example $p_1$ barrels per day.

At block 804, operations 800 continue with obtaining one or more second indications of second liquid production rates of one or more other wellbores. Continuing the example, the controller 107 may obtain an indication of a liquid production rate of another wellbore, for example $p_2$ barrels per day.

At block 806, operations 800 continue with determining a first slope, of a first curve relating a plurality of liquid production rates of the wellbore to a plurality of gas injection rates of the wellbore, at a point on the first curve corresponding to the first liquid production rate. Continuing the example, the controller 107 may determine a slope of a curve relating liquid production rates of the wellbore to gas injection rates of the gas lift system 100 (e.g., determined from previously collected production information of the wellbore), such as a curve similar to that shown in FIG. 2, at a point on the curve corresponding to the first liquid production rate (e.g., $p_1$ barrels per day). As an example, the controller may determine the slope to be $x_1$ barrel of oil per thousand standard cubic feet of lift gas.

Operations 800 continue at block 808 with determining one or more second slopes, of one or more second curves, each second curve relating a plurality of liquid production rates of one of the one or more other wellbores to a plurality of gas injection rates of the one of the other wellbores, each second slope being determined at a point on the second curve corresponding to one of the second liquid production rates of the one of the other wellbores. Continuing the example from above, the controller 107 may determine a second slope, of a second curve relating liquid production rates of another wellbore to gas injection rates of the other wellbore (e.g., determined from previously collected production information of the other wellbore), at a point on the second curve corresponding to the liquid production rate of the other wellbore (e.g., $p_2$ barrels per day). Still in the example, the controller 107 may then determine the second slope of the second curve to be $x_2$ barrels of oil per thousand standard cubic feet of lift gas.

At block 810, operations 800 continue with calculating a weighted average of the first slope and the second slopes, with the weighted average weighted based on the first and second liquid production rates of the wellbore and the other wellbores. Continuing the example above, the controller 107 may calculate a weighted average of the slope of the first curve and the second slope of the second curve. Using the exemplary values from above, the weighted average of the first slope and the second slope is:

$$((p_1 \cdot x_1)+(p_2 \cdot x_2))/(p_1+p_2)$$

Operations 800 continue at block 812 with determining a first gas injection rate such that a third slope, of the first curve, at a point on the first curve corresponding to the first gas injection rate, is equal to the calculated weighted average. Continuing the example above, the controller 107 may determine a first gas injection rate corresponding to a point on the first curve having a slope, $x_3$, equal to the calculate weighted average, $((p_1 \cdot x_1)+(p_2 \cdot x_2))/(p_1+p_2)$.

Operations 800 conclude at block 814 with causing injection of the lift gas into the wellbore at the first gas injection rate. Continuing the example above, the controller 107 may cause the lift gas pump 112 to inject lift gas into the wellbore at the first gas injection rate, for example, by adjusting on and off times of the lift gas pump 112, a speed of the lift gas pump 112, an output pressure of the lift gas pump 112, and/or valves controlling the flow of lift gas to the wellbore and the other wellbores.

While the operations 800 are described using the example of a controller located proximate to one wellbore of two wellbore, the disclosure is not so limited, and the operations 800 may be performed by a remote controller and/or by a human operator for groups of more than two wellbores.

Figure 9:
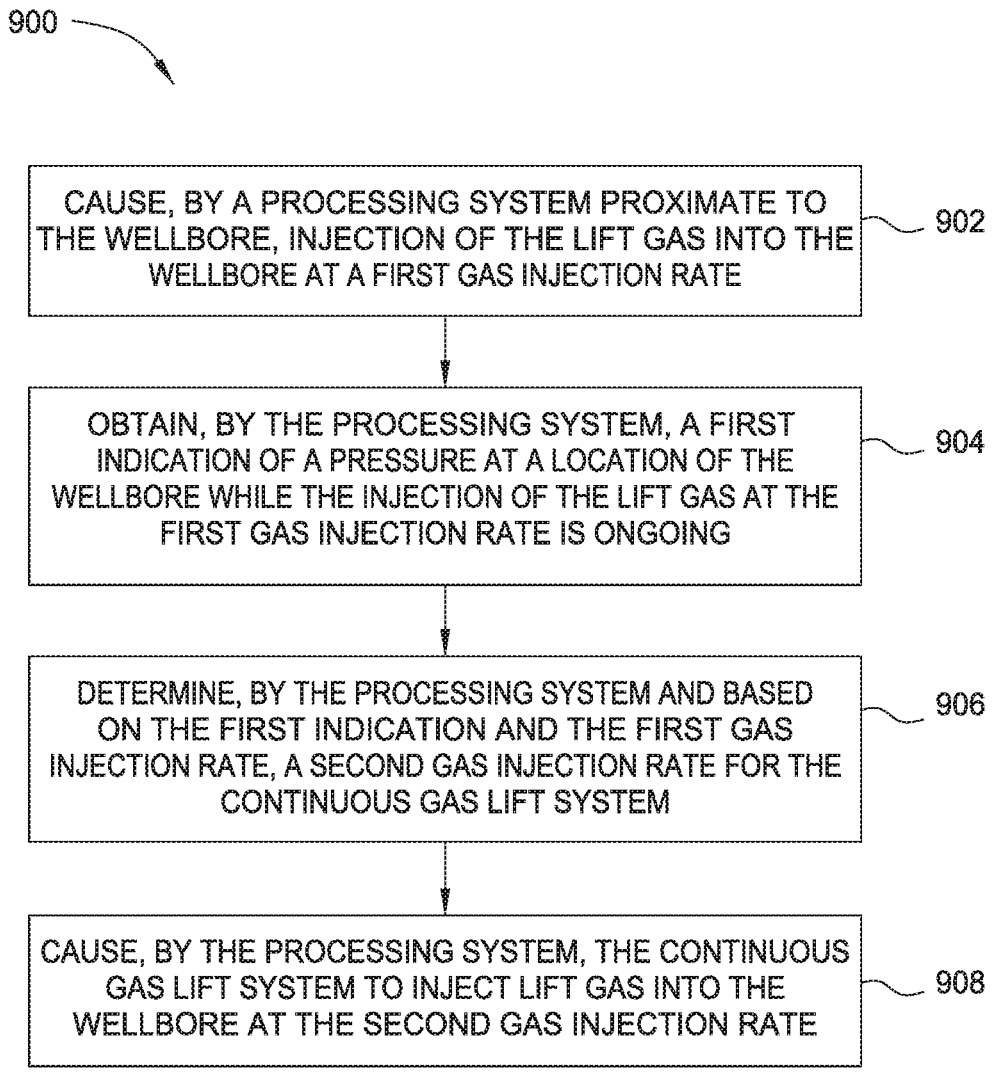
FIG. 9 is a flow diagram of example operations for operating a continuous gas lift system, in accordance with certain aspects of the present disclosure.

FIG. 9 illustrates example operations 900 for operating a continuous gas lift system operable to inject a lift gas into a wellbore for hydrocarbon production, in accordance with certain aspects of the present disclosure. Operations 900 begin at block 902 with causing, by a processing system proximate to the wellbore, injection of the lift gas into the wellbore at a first gas injection rate. For example, controller 107 may cause injection of lift gas into the wellbore 114 at a first gas injection rate (e.g., by causing the lift gas pump 112 to activate and/or by opening lift gas valves 122).

At block 904, operations 900 continue with obtaining, by the processing system, a first indication of a pressure at a location of the wellbore while the injection of the lift gas at the first gas injection rate is ongoing. Continuing the example, the controller 107 may obtain an indication of a bottom-hole pressure (BHP) of the wellbore from a sensor 110.

At block 906, operations 900 continue with determining, by the processing system and based on the first indication and the first gas injection rate, a second gas injection rate for the continuous gas lift system. Still in the example from above, the controller 107 may determine a second gas injection rate for the continuous gas lift system, based on the indication of the BHP and the first gas injection rate.

Operations 900 conclude at block 908 with causing, by the processing system, the continuous gas lift system to inject lift gas into the wellbore at the second gas injection rate. Continuing the example from above, the controller 107 may cause the lift gas pump 112 to inject lift gas into the wellbore at the second gas injection rate (e.g., by changing a speed of the lift gas pump 112 and/or by adjusting, opening, or closing lift gas valves 122).

According to aspects of the present disclosure, the processing system (e.g., controller 107) may cause injection of the lift gas into the wellbore at the first injection rate, obtain a first indication of a pressure at a location of the wellbore while the injection of the lift gas is ongoing, determine a second gas injection rate based on the first indication and the first gas injection rate, and cause the continuous gas lift system to inject gas into the wellbore at the second gas injection rate. The processing system may then obtain a second indication of a second pressure at the location while the continuous gas lift system is injecting lift gas at the second gas injection rate, determine a target pressure (e.g., a target pressure for the location, a target BHP), determine a third gas injection rate based on the first gas injection rate, the first pressure, the second gas injection rate, the second pressure, and the target pressure (e.g., by referring to a curve relating pressure to gas injection rate, such as curve 502, shown in FIG. 5), and then cause the continuous gas lift system to inject lift gas into the wellbore at the third gas injection rate.

In aspects of the present disclosure, the pressure at the location of the wellbore may comprise bottom-hole pressure (BHP) of the wellbore. For other aspects of the present disclosure, the pressure at the location of the wellbore may comprise a casing pressure of the wellbore.

Any of the operations or algorithms described above may be included as instructions in a computer-readable medium for execution by a controller or any suitable processing system. The computer-readable medium may comprise any suitable memory or other storage device for storing instructions, such as read-only memory (ROM), random access memory (RAM), flash memory, an electrically erasable programmable ROM (EEPROM), a compact disc ROM (CD-ROM), or a floppy disk.

The word "exemplary" is used herein to mean "serving as an example, instance, or illustration." Any aspect described herein as "exemplary" is not necessarily to be construed as preferred or advantageous over other aspects.

While the foregoing is directed to aspects of the present disclosure, other and further aspects of the disclosure may be devised without departing from the basic scope thereof, and the scope thereof is determined by the claims that follow.

The invention claimed is:

1. A method of operating an intermittent gas lift system operable to inject lift gas into a wellbore for hydrocarbon production, the method comprising:

causing, by a processing system proximate to the wellbore, injection of the lift gas into the wellbore at a first gas injection rate;

obtaining, by the processing system, an indication of a composition of a fluid at a wellhead associated with the wellbore, wherein the indication indicates that the fluid is more gas than liquid;

determining, by the processing system, a second gas injection rate of the intermittent gas lift system, wherein the determining comprises setting the second gas injection rate to a value greater than the first gas injection rate, based on the indication; and operating, by the processing system, the intermittent gas lift system according to the determination, wherein the operating comprises causing injection of the lift gas into the wellbore at the second gas injection rate.

2. The method of claim 1, wherein the operating comprises causing injection of the lift gas into the wellbore at the second gas injection rate for a first period and wherein the method further comprises:

determining a second period based on an indication of an arrival of the fluid at the wellhead associated with the wellbore; and causing, by the processing system, stopping of the injection of the lift gas during the second period.

3. The method of claim 2, further comprising:

starting a timer for the second period by the processing system; and causing, by the processing system, restarting of the injection of the lift gas upon expiration of the timer.

4. The method of claim 2, further comprising:

obtaining an indication of a liquid level at a location of the wellbore; and causing, by the processing system, restarting of the injection of the lift gas, based on the indication of the liquid level.

5. The method of claim 1, wherein the operating comprises causing injection of the lift gas into the wellbore at the second gas injection rate for a first period and wherein the method further comprises:

obtaining a first indication of a first pressure at a location of the wellbore;

determining a second period based on the first indication; and causing, by the processing system, stopping of the injection of the lift gas during the second period.

6. The method of claim 5, wherein the first pressure comprises a bottom-hole pressure (BHP) of the wellbore.

7. The method of claim 5, wherein the first pressure comprises a casing pressure of the wellbore.

8. The method of claim 5, further comprising:

obtaining a second indication of a second pressure at the location subsequent to the stopping of the injection of the lift gas; and causing, by the processing system, restarting of the injection of the lift gas, based on the second indication.

9. The method of claim 1, further comprising:

obtaining, by the processing system, a measurement of a first liquid production rate of the wellbore while injecting the lift gas at the first gas injection rate;

obtaining, by the processing system, a measurement of a second liquid production rate of the wellbore while injecting the lift gas at the second gas injection rate;

determining, by the processing system, a third lift gas injection rate based on the first gas injection rate, the first liquid production rate, the second gas injection rate, and the second liquid production rate; and causing, by the processing system, injection of the lift gas into the wellbore at the third lift gas injection rate.

10. The method of claim 1, further comprising:

causing, by the processing system, stopping of the injection of the lift gas at the end of a first period, and the method further comprises:

starting, by the processing system, a timer for a second period subsequent to the first period; and causing, by the processing system, restarting of the injection of the lift gas in response to expiration of the timer.

11. The method of claim 1, further comprising:

obtaining, by the processing system, an indication of a casing pressure associated with the wellbore;

determining a period based on the first gas injection rate, a depth of the wellbore, and the indication of the casing pressure; and causing, by the processing system, stopping of the injection of the lift gas at the end of the period.

12. A method of operating an intermittent gas lift system operable to inject lift gas into a wellbore for hydrocarbon production, the method comprising:

causing, by a processing system proximate to the wellbore, injection of the lift gas into the wellbore at a first gas injection rate;

obtaining, by the processing system, a first indication of a composition of a first fluid at a wellhead associated with the wellbore, wherein the first indication indicates that the first fluid is more liquid than gas;

determining, by the processing system and based on the first indication, a second gas injection rate of the intermittent gas lift system, wherein the determining comprises setting the second gas injection rate to a value equal to or greater than the first gas injection rate;

obtaining a second indication that a second fluid, arriving at the wellhead subsequent to the first fluid, is more gas than liquid;

resetting the second gas injection rate to another value less than the first gas injection rate, based on the second indication; and operating, by the processing system, the intermittent gas lift system according to the determination, wherein the operating comprises causing injection of the lift gas into the wellbore at the second gas injection rate after the resetting.

13. A system for injecting lift gas into a wellbore for hydrocarbon production, the system comprising:

a pump operable to intermittently inject the lift gas into the wellbore; and a processing system coupled to the pump and configured to:

cause the pump to inject the lift gas into the wellbore at a first gas injection rate;

obtain an indication of a composition of a fluid at a wellhead associated with the wellbore, wherein the indication indicates that the fluid is more gas than liquid;

determine a second gas injection rate by setting the second gas injection rate to a value greater than the first gas injection rate, based on the indication; and cause the pump to inject the lift gas into the wellbore at the second gas injection rate.

14. The system of claim 13, wherein the processing system is configured to cause the pump to inject the lift gas into the wellbore at the second gas injection rate for a first period and wherein the processing system is further configured to:

determine a second period based on an indication of an arrival of the fluid at the wellhead associated with the wellbore; and cause the pump to stop the injection of the lift gas during the second period.

15. The system of claim 14, wherein the processing system is further configured to:

start a timer for the second period; and cause a restarting of the injection of the lift gas upon expiration of the timer.

16. The system of claim 14, wherein the processing system is further configured to:

obtain an indication of a liquid level at a location of the wellbore; and cause a restarting of the injection of the lift gas, based on the indication of the liquid level.

17. The system of claim 13, wherein the processing system is configured to cause the pump to inject the lift gas into the wellbore at the second gas injection rate for a first period and wherein the processing system is further configured to:

obtain a first indication of a first pressure at a location of the wellbore;

determine a second period based on the first indication; and cause the pump to stop the injection of the lift gas during the second period.

18. The system of claim 17, wherein the first pressure comprises a bottom-hole pressure (BHP) of the wellbore.

19. The system of claim 17, wherein the processing system is further configured to:

obtain a second indication of a second pressure at the location subsequent to causing the pump to stop the injection of the lift gas; and cause the pump to restart the injection of the lift gas, based on the second indication.

20. The system of claim 13, wherein the processing system is further configured to:

obtain a measurement of a first liquid production rate of the wellbore while the pump is injecting the lift gas at the first gas injection rate;

obtain a measurement of a second liquid production rate of the wellbore while the pump is injecting the lift gas at the second gas injection rate;

determine a third lift gas injection rate based on the first gas injection rate, the first liquid production rate, the second gas injection rate, and the second liquid production rate; and cause the pump to inject the lift gas into the wellbore at the third lift gas injection rate.

21. The system of claim 13, wherein the processing system is further configured to:

cause the pump to stop injection of the lift gas into the wellbore at the end of a first period;

start a timer for a second period subsequent to the first period; and cause the pump to restart the injection of the lift gas in response to expiration of the timer.

22. The system of claim 13, wherein the processing system is configured to:

obtain an indication of a casing pressure associated with the wellbore;

determine a period based on the first gas injection rate, a depth of the wellbore, and the indication of the casing pressure; and cause the pump to stop the injection of the lift gas at the end of the period.

23. A system for injecting lift gas into a wellbore for hydrocarbon production, the system comprising:

a pump operable to intermittently inject the lift gas into the wellbore; and a processing system coupled to the pump and configured to:

cause the pump to inject the lift gas into the wellbore at a first gas injection rate;

obtain a first indication of a composition of a first fluid at a wellhead associated with the wellbore, wherein the first indication indicates that the first fluid is more liquid than gas;

determine, based on the first indication, a second gas injection rate by setting the second gas injection rate to a value equal to or greater than the first gas injection rate;

obtain a second indication that a second fluid, arriving at the wellhead subsequent to the first fluid, is more gas than liquid;

reset the second gas injection rate to another value less than the first gas injection rate, based on the second indication; and cause the pump to inject the lift gas into the wellbore at the second gas injection rate after the processing system resets the second gas injection rate to the other value.

24. A non-transitory computer-readable medium containing a program which, when executed by a processing system, causes the processing system to perform operations comprising:

causing an intermittent gas lift system to inject lift gas into a wellbore at a first gas injection rate;

obtaining an indication of a composition of a fluid at a wellhead associated with the wellbore, wherein the indication indicates that the fluid is more gas than liquid;

determining a second gas injection rate of the intermittent gas lift system, wherein the determining comprises setting the second gas injection rate to a value greater than the first gas injection rate, based on the indication; and causing the intermittent gas lift system to operate according to the determination, wherein the operating comprises causing injection of the lift gas into the wellbore at the second gas injection rate.

* * * * *